United States Patent [19]

Finney, Jr. et al.

[11] Patent Number: 4,587,475

[45] Date of Patent: May 6, 1986

[54] MODULATED POWER SUPPLY FOR AN ELECTROSTATIC PRECIPITATOR

[75] Inventors: James A. Finney, Jr., Whippany; Frank Gallo, Wanaque, both of N.J.

[73] Assignee: Foster Wheeler Energy Corporation, Livingston, N.J.

[21] Appl. No.: 517,107

[22] Filed: Jul. 25, 1983

[51] Int. Cl.[4] ..... B03C 3/68

[52] U.S. Cl. ..... 323/241; 55/139; 323/903

[58] Field of Search ..... 323/239, 241, 903, 282; 307/1, 2; 363/86; 55/105, 139

[56] References Cited

U.S. PATENT DOCUMENTS

| | | | |
|---|---|---|---|
| 517,105 | 7/1883 | Finney . | |
| 1,130,213 | 3/1915 | Steere . | |
| 2,634,818 | 4/1953 | Wintermute | 183/7 |
| 3,039,252 | 6/1962 | Guldemond et al. | 55/105 |
| 3,048,955 | 8/1962 | Little | 55/2 |
| 3,049,848 | 8/1962 | Klemperer | 55/105 |
| 3,271,931 | 9/1966 | Taylor | 55/105 |
| 3,374,609 | 3/1968 | Kide | 55/105 |
| 3,443,361 | 5/1969 | Drenning | 55/105 |
| 3,577,708 | 5/1971 | Drenning | 55/139 |
| 3,641,740 | 2/1972 | Schumann et al. | 55/139 |
| 3,877,897 | 3/1975 | Glucksman | 55/111 |
| 3,984,215 | 10/1976 | Zucker | 55/105 |
| 4,233,039 | 11/1980 | Schmidt | 323/903 |
| 4,284,417 | 8/1981 | Reese et al. | 55/139 |
| 4,290,003 | 9/1981 | Lanese | 323/241 |
| 4,308,494 | 12/1981 | Gelfand et al. | 55/105 |
| 4,311,491 | 1/1982 | Bibbo et al. | 55/2 |
| 4,318,152 | 3/1982 | Weber | 361/92 |
| 4,354,152 | 10/1982 | Herklotz et al. | 323/241 |
| 4,410,849 | 10/1983 | Ando | 55/105 |
| 4,413,225 | 11/1983 | Dönig et al. | 323/903 |
| 4,445,911 | 5/1984 | Lind | 323/903 |
| 4,502,002 | 2/1985 | Ando | 55/105 |

FOREIGN PATENT DOCUMENTS

| | | |
|---|---|---|
| 34075 | 8/1981 | European Pat. Off. . |
| 697437 | 9/1953 | United Kingdom . |
| 717705 | 11/1954 | United Kingdom . |
| 1129745 | 10/1968 | United Kingdom . |
| 1463130 | 2/1977 | United Kingdom . |
| 1476877 | 6/1977 | United Kingdom . |
| 2012493 | 7/1979 | United Kingdom . |
| 1566242 | 4/1980 | United Kingdom . |
| 1582194 | 12/1980 | United Kingdom . |
| 2096845 | 10/1982 | United Kingdom . |

OTHER PUBLICATIONS

Parajust Y—is a variable frequency speed control for three phase AC motors. It was specifically designed for speed control of motors used to drive pumps, fans or blowers so as to save energy on these applications.

*Primary Examiner*—Patrick R. Salce
*Assistant Examiner*—D. S. Rebsch
*Attorney, Agent, or Firm*—Marvin A. Naigur; John E. Wilson; Thomas L. Adams

[57] ABSTRACT

In an electrostatic precipitator system powered by a primary power source, the power supply has a converter and a high voltage device. The converter can be coupled to the primary power source for producing a converter voltage with a different frequency content. The high voltage device is driven by the converter, producing from its converted voltage a high voltage. This high voltage is influenced by the different frequency content, having at least one frequency component at a predetermined low frequency which is sized to promote efficient precipitation.

14 Claims, 6 Drawing Figures

0V
PL
PE
-45KV

0V
DL
PL
PE
-45KV t
t
t
HC1
IN3
IN2
IN6
(3a)
(3b)
(3c)

P12
P10
Q4
Q6
R32
R34
110
112
60
80
120
PE
CL
94
508
L6
DI
DA
SEL
506
504
307200
2457600
ONE SHOT
502
÷n
500
120

MODULATED POWER SUPPLY FOR AN ELECTROSTATIC PRECIPITATOR

BACKGROUND OF THE INVENTION

The present invention relates to electrostatic precipitators, and in particular, to controllable power supplies for electrostatic precipitators.

It is known (U.S. Pat. No. 4,290,003) to provide a power supply which has a pair of anti-parallel SCRs (thyristors) coupled through a high voltage transformer to a rectifier bridge. The thyristors can be controlled by a microcomputer that can sense various operational parameters of the precipitator and its power supply. In response to various changes in precipitator parameters, this known system can adjust the extent of drive through the power supply in anticipation of imminent sparking, thereby reducing the likelihood of sparking. As such, the microcomputer-controlled power supply can operate quickly and accurately and achieve control not readily obtainable with older voltage controllers.

It is also known to produce a high voltage by constructing a high frequency power oscillator which drives a high voltage transformer. Since the high voltage transformer operates at a relatively high frequency it can have a relatively small core, which tends to reduce fabrication costs.

In practical precipitator power supplies, the high electrostatic potential within the precipitator will occasionally cause a spark. A precursor of this spark can be a back-corona effect, wherein ions of the wrong potential tend to migrate within the field. This back-corona effect produces a negative resistance which tends to hasten a voltage breakdown or sparking condition. The instant prior to sparking exhibits a potential distribution wherein a significant potential gradient exists across any dust layer on the precipitator plates. A spark often dislodges a portion of the dust layer and creates a discontinuity in the potential gradients in the vicinity of a recent spark. It has been found that this discontinuity tends to foster further back-corona effects and sparking.

An important consideration in running a precipitator efficiently is keeping the average potential in the precipitator sufficiently high to cause a high extent of precipitation but not so high as to cause a rapid rate of sparking. It has been found that the potential across the dust layer in a precipitator does not necessarily initiate a spark instantaneously. Therefore, the possibility exists of briefly applying a high electrostatic potential during a transient period of time sufficiently short and infrequent so as to avoid excessive voltage across the dust layer. Since the dust layer is not excessively stressed by this high potential, there is a reduced likelihood of sparking.

Accordingly, there is a need for an improved power supply for an electrostatic precipitator that can operate with a high voltage that is periodically increased at a relatively low repetition rate, thereby increasing the extent of precipitation without inducing unnecessary sparking.

SUMMARY OF THE INVENTION

In accordance with the illustrative embodiments demonstrating features and advantages of the present invention, there is provided in an electrostatic precipitator system powered by a primary power source, a power supply. This supply has a converter means and a high voltage means. The converter means is adapted to be coupled to the primary power source for producing a converted voltage with a different frequency content. The high voltage means is coupled to and driven by this converter means for producing from its converted voltage, a high voltage. This high voltage is influenced by the different frequency content. This content has at least one frequency component at a predetermined low frequency sized to allow efficient precipitation.

Also in accordance with a related method of the same invention, an electrostatic precipitator can be powered from a primary power source. The method includes the step of converting the primary power source into a converted voltage having a different frequency content. The method also includes the step of producing from this converted voltage a high voltage influenced by the different frequency content. This content has at least one frequency component at a predetermined low frequency, sized to allow efficient precipitation.

By employing apparatus and methods according to the above, an improved and highly efficient precipitation is achieved. In a preferred embodiment, a pair of anti-parallel thyristors are coupled to a transformer/-rectifier set. The thyristors are controlled by a microcomputer which sets the angle of conduction of the thyristors according to its internal program. The internal program regulates the conduction angle in accordance with measurements of various operational parameters. In this preferred embodiment, the conduction angle is also periodically increased. For example, the conduction angle can be increased for one-half cycle by a factor of eight at every sixth half cycle. Of course, other increase factors and duty cycles can be chosen depending upon the particular exhaust being treated.

While it is preferred to program the periodic increase in conduction angle through a program contained in memory, a discrete, hard-wired apparatus for producing the same periodic increase in conduction angle is also disclosed. In one embodiment, a counter detects every nth half cycle. During that nth half cycle, the conduction angle is increased by a predetermined factor. In this embodiment the conduction angle is established by a digital counter which divides each half cycle into a given number of pulses. The reaching of a predetermined count indicates the elapsing of a corresponding portion of the conduction angle. A clock involved in this counting of divisions of the conduction angle can be changed in frequency, to effectively multiply the conduction angle by a predetermined factor.

BRIEF DESCRIPTION OF THE DRAWING

The above brief description as well as other features and advantages of the present invention will be more fully appreciated by reference to the following detailed description of a presently preferred but nonetheless illustrative embodiment in accordance with the present invention when taken in conjunction with the accompanying drawings, wherein.

DETAILED DESCRIPTION OF THE PREFERRED EMBODIMENT

Figure 1:
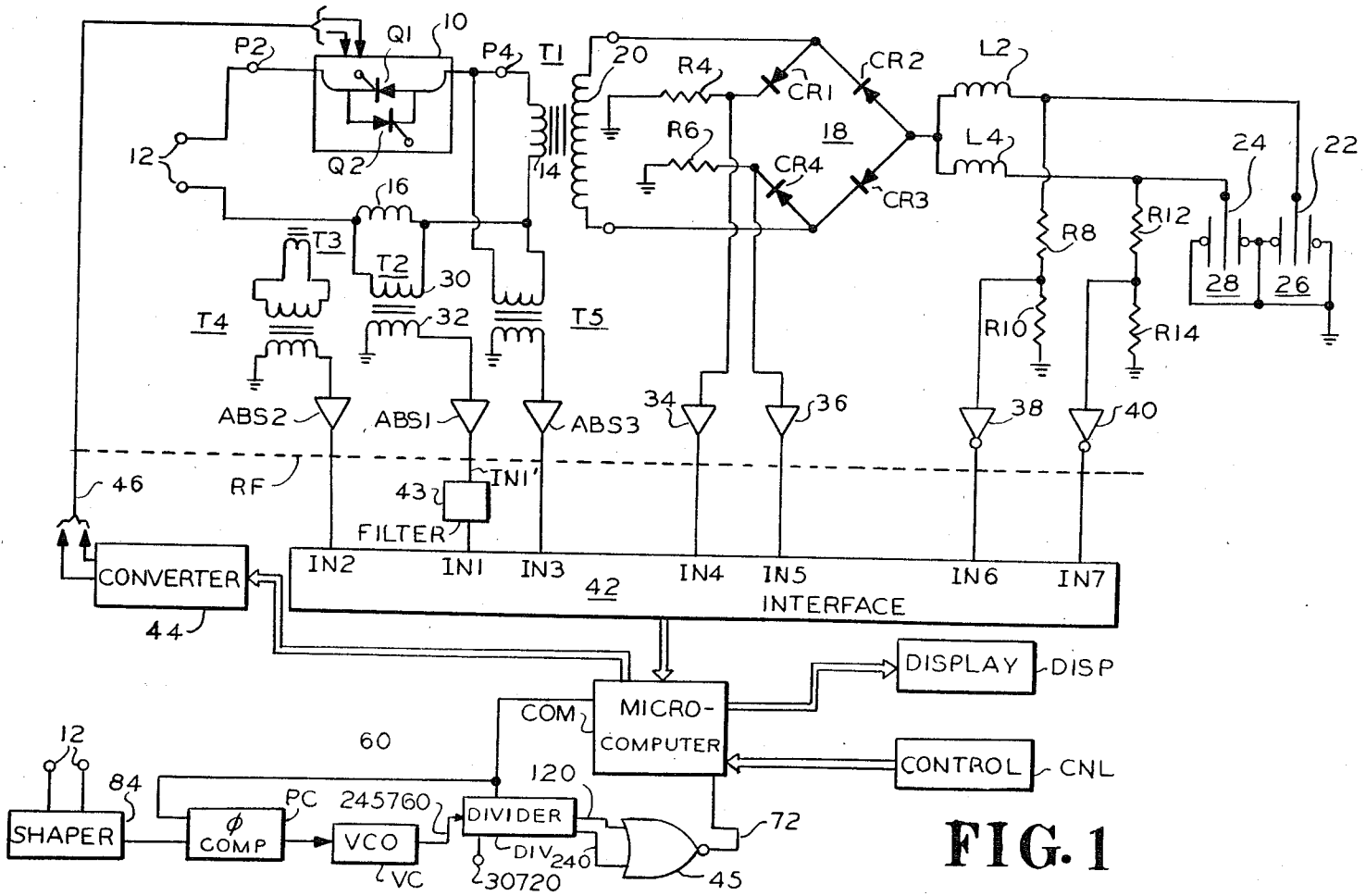
FIG. 1 is a simplified schematic diagram of an electrostatic precipitator system according to the principles of the present invention.
Figures 3, 4A, 4B, 5:
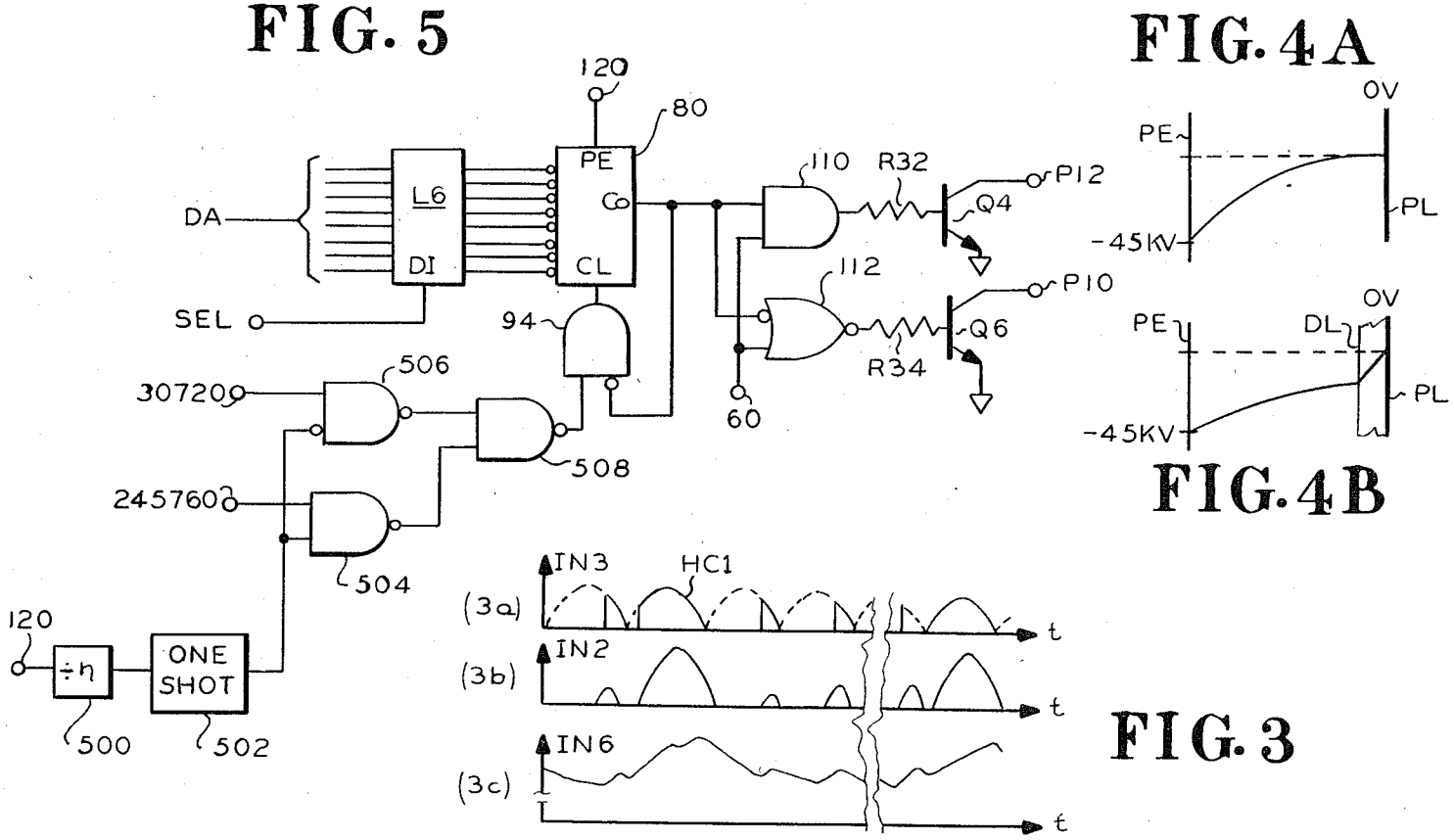
FIG. 3 is a timing diagram illustrating the changing voltages associated with the apparatus of FIG. 1.
FIGS. 4A and 4B are potential diagrams showing the potential distribution within an electrostatic precipitator for a relatively clean and dusty precipitator plate, respectively.
FIG. 5 is a simplified schematic diagram of a portion of a converter which is an alternate to that disclosed in FIG. 1.

In FIG. 1 a voltage controller, part of a converter means, is shown as block 10 connected between input line P2 and output line P4. Block 10 has a pair of oppositely poled thyristors (SCR's) Q1 and Q2 connected in anti-parallel between lines P2 and P4 so that they can support an alternating current. By triggering thyristors Q1 and Q2 to conduct through a desired phase angle, the extent of conduction can be controlled in a well-known manner. A typical thyristor connection is shown in FIG. 3 of U. S. Pat. No. 4,290,003. While a thyristor controller is shown, it is apparent that other controllers employing elements such as a MOSFET transistor or a saturable reactor may be employed instead. Alternatively, if power source 12 were a direct current source, controller 10 could be an appropriate chopper circuit.

A high voltage means is shown herein as a transformer-rectifier set T1, 18. A conductive element is shown as limiting inductor 16, which is in series circuit across the primary power input terminals 12, together with controller 10 and primary 14 of high voltage transformer T1. The high voltage means includes transformer T1 and full wave bridge 18 comprising diodes CR1, CR2, CR3 and CR4. The anode of diode CR1 and the cathode of diode CR2 are connected to one terminal of secondary 20, its other terminal being connected to the cathode of diode CR3 and the anode of diode CR4. The cathodes of diodes CR1 and CR4 are shunted to ground by resistors R4 and R6, respectively. The anodes of diodes CR2 and CR3 are connected to the junction of surge-limiting inductors L2 and L4. Having a high turns ratio, transformer T1 produces a negative, direct current voltage at the junction of inductors L2 and L4, which is of a high magnitude.

While conductive element 16 is shown as a current limiting reactor, it is apparent that a resistive element may be employed in other embodiments. Being inductive, element 16 has the advantage of being responsive to transient phenomena indicative of imminent sparking.

The non-common terminals of inductors L2 and L4 are separately connected to high tension electrodes 22 and 24, respectively, of precipitators 26 and 28. Precipitators 26 and 28 are constructed in a well-known manner and are disposed in the path of the exhaust from a machine or a process. Sufficiently high electric fields within precipitators 26 and 28 will ionize and deflect particles in the exhaust, thereby cleansing it.

Figure 2:
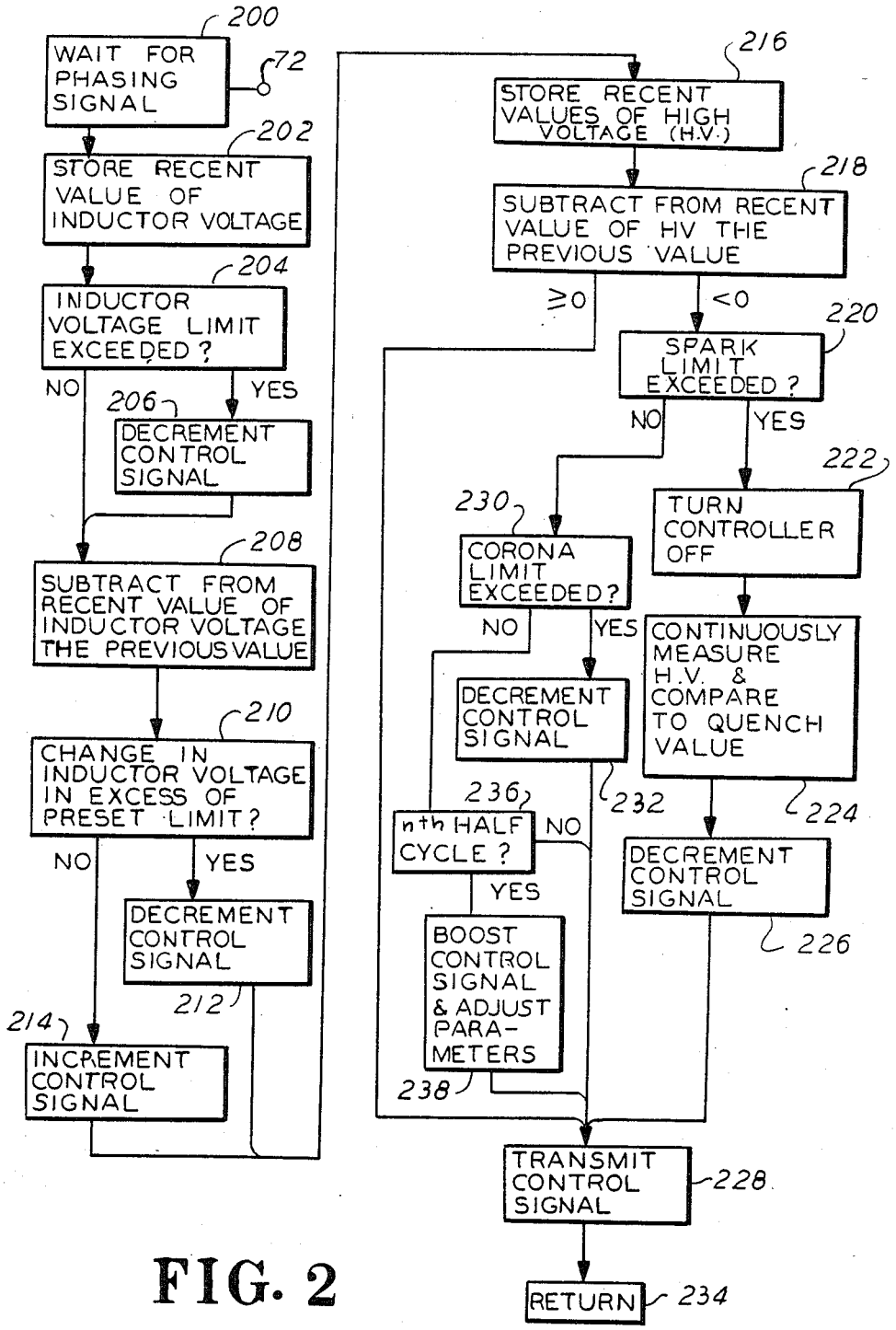
FIG. 2 is a flowchart associated with the microcomputer of FIG. 1

Element 16 is connected in parallel with primary 30 of transformer T2 and its secondary 32 is connected between ground and the input of absoluting buffer ABS1. Absoluting buffer ABS1 (which may be constructed as shown in FIG. 2 of U.S. Pat. No. 4,290,003) produces a unipolar signal having a magnitude proportional to the absolute value of its input, although a Hall-effect device or other apparatus may be used instead.

A signal proportional to the primary current of transformer T1 is provided by current transformer T3 which is inductively coupled to the line between input 12 and element 16. Current transformer T3 is coupled to absoluting buffer ABS2 by means of isolation transformer T4. Absoluting buffer ABS2 is identical in construction to buffer ABS1. The primaries of transformers T1 and T5 are connected in parallel. The secondary of transformer T5 drives the input of absoluting buffer ABS3 whose construction is identical to that of buffer ABS1. It is apparent that buffers ABS2 and ABS3 are driven by voltages proportional to the primary current and voltage, respectively, of high voltage transformer T1. The secondary current of transformer T1 flows through either resistor R4 or R6, this current alternating therebetween for successive half-cycles. This secondary current signal is transmitted by non-inverting buffer amplifiers 34 and 36 which are separately connected to the ungrounded terminals of resistors R4 and R6, respectively.

A high voltage sensing means is shown herein as a pair of dividers, although a Hall-effect device or other apparatus may be used instead. Connected between high tension electrode 22 and ground is one such voltage divider, comprising serially connected resistors R8 and R10. Similarly, a divider, comprising serially connected resistors R12 and R14, is connected between high tension electrode 24 and ground. The junction of resistors R8 and R10 is connected to the input of inverting buffer amplifier 38 to drive it with a voltage proportional to the operating potential of precipitator 26. Similarly inverting buffer amplifier 40, being connected to the junction of resistors R12 and R14, is driven with a voltage proportional to the operating potential of precipitator 28.

For many applications, it will be convenient to locate the just described apparatus of FIG. 1 near precipitators 26 and 28. Frequently such equipment will be located adjacent to one or more smoke stacks. Since the balance of equipment can be located at a place conveniently accessible to an operator, such partitioning is indicated by dotted partition line RF.

The outputs of buffers ABS2, ABS3, 34, 36, 38 and 40 interface with inputs IN2, IN3, IN4, IN5, IN6 and IN7, respectively, of subsystem 42. The output of buffer ABS1 is coupled to signal conditioning circuit 43 whose output is connected to input IN1 of subsystem 42. Circuit 43 is preferably a low pass filter; however, in some embodiments an integrator may be employed instead. While supplying seven different inputs to subsystem 42 in this manner provides reasonably detailed information on precipitator performance, it is expected that in other embodiments a different number of inputs may be employed. Subsystem 42 is part of a command means and includes triggered monitors, such as the one shown in FIG. 4 of U.S. Pat. No. 4,290,003. The command means (part of the converter means) also includes microcomputer COM. Microcomputer COM may be constructed substantially as described in U.S. Pat. No. 4,290,003. The coupling between subsystem 42 and microcomputer COM is shown as a broad arrow to suggest the existence of more than one data line and the directional flow of information. Microcomputer COM is operative to repetitively strobe inputs IN1–IN7 so that these inputs are effectively multiplexed into microcomputer COM. Microcomputer COM is also operative to transmit a control signal to subsystem 44. Subsystem 44 (an example of one being given hereinafter) is arranged to convert the control signal produced by microcomputer 42 into a pair of timing signals which are transmitted along lines 46 to controller 10 to control its conduction angle. Obviously subsystem 44 provides a suitable interface between controller 10 and command means 42.

Accordingly, the structure of subsystem 44 would be significantly different if instead of thyristors, controller 10 employed a MOSFET transistor, saturable reactor or other device. An operator may provide input to microcomputer COM by operating switches in control accessory CNL. Microcomputer COM can display information to an operator by means of display accessory DISP. Elements CNL and DISP may be constructed substantially as shown in FIG. 6 of U.S. Pat. No. 4,290,003.

Microcomputer COM, which provides overall system control and timing may take any one of several forms. It is preferable that microcomputer COM be constructed with a commercially available microprocessor, however, many alternate structures will be readily apparent to persons skilled in the art. In fact in some embodiments, analog circuitry may be employed. For example, selectable storage capacitors may be charged to potentials representing the signals on inputs IN1–17 at various instants of time. These stored charges may be selectively coupled to a combining network to produce a control signal.

Microcomputer COM establishes the rates and sequence in which each of the inputs IN1–IN7 transmits its respective signal to command means COM. In this embodiment this rate will be normally twice the power line frequency but subject to substantial increase under predetermined conditions. It is apparent that other rates may be employed to suit the characteristics of a specific voltage controller and precipitator.

Primary power lines 12 are also connected to a pair of inputs of shaper 84. Shaper 84, an amplifier, rapidly saturates to produce a square wave output synchronously with the power line frequency. This output of shaper 84 is applied as one comparison input to phase comparator PC. Phase comparator PC has another input 60 which is nominally at 60 Hz. In a well known fashion, a phase differential between line 60 and the output of shaper 84 produces an error signal from phase comparator PC. This error signal is applied to voltage controlled oscillator VC to regulate its frequency of oscillation. Oscillator VC has an integrating type of control so that the oscillator continues to change frequency until the output of the phase comparator is zero. It will be appreciated that the signal on line 60 is square wave synchronous with the 60 Hz power line frequency applied to terminals 12 of shaper 84. Voltage controlled oscillator VCO nominally produces on output line 245760 a signal operating at 240.76 kHz. This output is applied to the input of divider DIV, a decade divider which is operable to divide the 245.76 kHz signal into outputs nominally at 30.72 kHz, 240 Hz, 120 Hz and 60 Hz on lines 30720, 240, 120, and 60, respectively. Line 60 is provided as an input to microcomputer COM on one of its sense lines. Thus the microcomputer can determine the current phasing of the power line. Also, a signal indicating that 75% of the current half cycle has expired is produced on line 72, another sense input of microcomputer COM. Signals on line 120 and line 240 at twice and four times line frequency are fed into separate inputs of NOR gate 45. It will be appreciated that the resulting pulse on line 72 indicates the prevalence of the last 25% of each half cycle. This signal is employed in the manner described hereinafter.

In order to facilitate an understanding of the apparatus of FIG. 1 its operation will be briefly described under the conditions where sparking is imminent, where it has occurred, where back-corona is present and normal conditions.

Assume the apparatus of FIG. 1 has been recently energized and is producing a relatively low voltage on electrodes 22 and 24. Microcomputer COM addresses and receives data from inputs IN6 and IN7 for every half cycle of the power line input 12. This data, including the voltage on electrodes 22 and 24, is received after approximately 75% of a half cycle has elapsed. Such timing allows microcomputer COM to fairly assess the conditions presently existing during each half cycle and to adjust the control signal of line 46 in advance of the succeeding half cycle. For awhile, the control signal is periodically advanced every half cycle to increase the voltage of electrodes 22 and 24. The incrementation of the control signal of line 46 may in some embodiments be scaled down as the voltages of electrodes 22 and 24 approach their rated values. It is assumed in this example that sufficient voltage will cause a condition such that sparking is imminent.

Assume now that during the next half cycle the coronas in precipitators 26 and 28 distend and form projections or "flares." Such distension is the precursor of sparking and it produces a distinctive increase in precipitator current. This increase in precipitator current produces an increased voltage drop across element 16. Since the current perturbation caused by this corona distension contains substantial high frequency components, inductor 16 is especially sensitive thereto. In addition, since corona distension is likely to occur in the latter part of a half cycle of power input 12, the fact that microcomputer COM takes its measurement during that time makes it particularly sensitive to this phenomenon.

Upon receiving a measurement from input IN1 after the elapse of at least 75% of the then-existing half cycle, microcomputer COM compares this latest measurement against a preset threshold (for example, 2 volts). Referring to the flow diagram of FIG. 2, this sequence is shown as several branches. At branch 200 the system waits for a phasing signal at terminal 72 (FIG. 1) indicating elapse of at least 75% of the half cycle. It is preferable to allow as much as possible of the current half cycle to elapse in order to allow calculations to occur during the quiescent period at the beginning of each half cycle when the thyristors 10 are off. At branch 202 the signal from input IN1 is stored and at branch 204 the threshold comparison is performed. If the threshold is exceeded the control signal (line 46 of FIG. 1) is decremented as shown at branch 206 by a factor of approximately 1%. This decrement is chosen to suit the characteristics and response time of the precipitator being controlled.

After this operation (or assuming branch 206 was skipped because the threshold of branch 204 was not exceeded) the recently measured value of input IN1 has subtracted from it the previous value of IN1, as shown at branch 208. This difference is compared to a preset limit (for example 10%) as shown at branch 210 and if the limit is exceeded, the control signal is decremented, otherwise it is incremented. This decrementation and incrementation is shown at branches 212 and 214, respectively. The extent of decrementation is chosen to suit the characteristics and response time of the precipitator. The extent of incrementation at branch 214 is less than the decrement occurring at branch 206. This relation will ensure that if decrementation occurs, its effect will not be overcome by the incrementation at branch 214.

The result of the foregoing steps is that if element 16 (FIG. 1) indicates imminent sparking the control signal (line 46 of FIG. 1) is decreased, otherwise it is increased. Thus the high voltage applied to precipitators 26 and 28 is at a relatively large value, just below the point at which sparking occurs. In this embodiment the control signal is varied by a fixed amount, although in other embodiments, the amount of change can be obtained according to a table, a formula or according to other measured parameters.

The foregoing described an operation in which sparking was prevented. In the event, however, that some massive disturbance produces a spark anyway, the following describes the system response thereto.

Assume that in the middle of a half cycle of power input 12 (FIG. 1) sparking commences in precipitator 26. As a result, the voltage on high tension electrode 22 abruptly falls. The relatively small voltage consequently produced at input IN6 is detected by microcomputer COM shortly thereafter. The latest value of IN6 is compared to the value occurring one-half cycle earlier, and if it exceeds a predetermined limit (for example, 25%) command means COM responds to this emergent condition by bringing the control signal on line 46 to a minimum value. This feature is also illustrated in the flow diagram of FIG. 2 which shows that immediately after the operation of previously described branch 212 or 214, the recent values of high voltage, obtained from inputs IN16 and IN6, are stored into memory (step 216). These recent values have subtracted from them the corresponding value of high voltage stored from the previous half cycle (step 218). If these differences are both greater than or equal to zero, no further adjustments to the control signal occur and the routine recycles as described hereinafter. If either of these differences are negative, indicating a fall in the high voltage, a comparison is made to a preset spark limit to determine if a spark has occurred. If the limit has been exceeded the following occurs as indicated by branches 220, 222, 224, and 226 of the flow diagram (FIG. 2).

The control signal is reset to zero in an attempt to disable controller 10 (FIG. 1). However, if the thyristors of controller 12 are already conducting they will continue to conduct at least until the end of the half cycle of power input 12. Since a spark appears to have commenced, microcomputer COM begins demanding data from input IN6 and IN7 at a relatively high rate. This elevated rate is important since controller 10 must remain off so long as sparking persists. Also, because the voltage needed to initiate a spark is substantially higher than the voltage needed to sustain it, the spark does not extinguish until the electrode voltage declines substantially. Therefore the voltages at inputs IN6 and IN7 are monitored on a "real time" basis until they recede below a quench value which insures spark extinction.

The time required to extinguish a spark can vary upon each occurrence thereof. For these reasons microcomputer COM disables controller 10 for as long as the voltge on electrode 22 or 24 remains excessive. Once this voltage is no longer excessive the control signal is restored but at a value perhaps smaller (for example 0 to 4% reduction) than that existing in the half cycle in which sparking occurred. In this fashion the likelihood of repeated sparking is avoided.

Assuming the high voltages subside to below a quench value shortly after the commencement of a succeeding half cycle of power input 12, the operation associated with branch 228 (FIG. 2) occurs. This operation is the transmission of the restored control signal, followed by a return to the beginning of the sequence of operations, as indicated by branch 234. Having restored the control signal, one of the thyristors of controller 10 (FIG. 1) again conducts at a time (phase angle) determined by the control signal.

The foregoing sequence of operations just described in connection with FIG. 2 constitutes one microcomputer programming cycle. Accordingly, the microcomputer awaits the next occurrence of a phasing signal at the elapse of at least 75% of the current half cycle of power input 12, as indicated by branch 200.

The above sequence comprised a power cycle wherein sparking had occurred and wherein branch 222 (FIG. 2) was executed instead of branch 230. Accordingly, after microcomputer COM (FIG. 1) determines that the decrement in the high voltage measurements of inputs IN6 and IN7 does not indicate sparking, the operation illustrated as branch 230 (FIG. 2) commences. This operation consists of determining whether this moderate decrease in high voltage exceeds a threshold (for example 5%) which would indicate a back-corona effect. If this corona limit is exceeded the control signal is decremented a predetermined amount (for example 1%) as indicated in branch 232. This decrement is greater than the increment which may be produced by the operation associated with branch 214. While the variation just described for the signal was a fixed decrement, in other embodiments a table, a formula or the value of the measured inputs IN1–IN5 may be employed to determine the variation of the control signal during the occurrence of a back-corona effect. With the foregoing approach the voltages on electrodes 22 and 24 are periodically increased until the back-corona occurs. Upon occurrence of the back-corona, the conduction angle of controller 10 is decreased. In this manner, electrode voltage is kept around a peak which represents relatively high efficiency. It is apparent that if a back-corona did not occur and if the voltage to current characteristics of precipitators 26 and 28 were monotonic, then the precipitator voltage would increase until sparking was imminent.

In the event that the corona limit of step 230 is not exceeded, programming step 236 is executed. The program of microcomputer COM continually counts the number of half cycles of power source 12 elapsing. In one embodiment the program awaits the arrival of every sixth half cycle. For a 60 Hz line frequency this means the program awaits passage of successive fifty millisecond intervals. On the sixth half cycle, the program does not skip immediately to step 228 but first executes programming step 238. In step 238 the control signal is boosted by a predetermined amount. In one constructed embodiment, the conduction angle represented by the control signal, is increased by a factor of 8. For example, were the conduction angle currently at 20°, it would now be increased to 160°. It will be understood that the number of half cycles that microcomputer COM awaits before boosting the control signal, can be varied depending upon the installation. For some applications where the tendency to spark is relatively high, the number of half cycles awaited can be increased. Similarly, where a likelihood of sparking is high, the amount by which the conduction angle is increased can be moderated. Also, while a multiplication of the conduction angle is described, in other embodiments the conduction angle can be increased by a predetermined amount. Of course, in embodiments in which the amplitude of the signal applied to high voltage transformer T1 (FIG. 1) is directly controlled, the adjustments will be made to amplitude and not to conduction angle.

The absolute value of the voltage applied to the primary of high voltage transformer T1, which is the input IN3 of interface 42 (FIG. 1), is graphically illustrated in the time-plot 3*a* of FIG. 3. As shown therein the voltage falls within a full-wave rectified sinusoid and its conduction angle for most half cycles is relatively small. However, as discussed above (step 238 of FIG. 2), at half cycle HC1, the conduction angle is greatly increased to prevail throughout the majority of the half cycle. Referring to plot 3*b* of FIG. 3, current IN2 sensed at the interface 42 (FIG. 1), greatly increases during this interval. Simultaneously, the voltage IN6 measured at interface 42 similarly rises to a relatively high peak during this interval. Thereafter, the voltage displays the typical ripple effect common in AC rectified circuits.

In step 238 certain parameters associated with steps 204, 210, 220 and 230 are changed to avoid interpretation of the following boosted half cycle as a faulty condition. These changed parameters apply for only the next half cycle when boosted values are measured, except as otherwise noted. Specifically, in the next execution of steps 204 and 210 any violation of the inductor voltage is ignored since this voltage will appear excessively high. Similarly the limit tests of steps 220 and 230 will be suppressed. Instead of suppressing the subsequent limit, tests can be conducted with more liberal limits. Alternatively, the tested values can be established at not their actual measured value but at their previously unboosted values.

Significant to note is the fact that the voltage IN6 stays normally at a modest value except for a periodic peaking which occurs herein at every sixth half cycle. This peaking is beneficial since it increases the extent of precipitation. The resulting brief, but relatively high potential, ionizing field within the precipitator helps to insure a more thorough precipitation phenomena. However, the moderation of this potential immediately thereafter allows voltages to stabilize.

Referring to FIG. 4*a*, a plot of potential between precipitator electrode PE and precipitator plate PL is shown to rise from a maximum negative potential of 45 kV to zero volts in exponential fashion. When a dust layer DL is present on the plate PL (FIG. 4*b*), the potential distribution changes significantly. A substantial amount of the voltage drop occurs across the dust layer DL. This phenomena makes more likely the occurrence of a spark affecting this dust layer. Occurrence of a spark at the dust layer will dislodge a portion of the dust layer and open a low-potential window onto the plate. It has been found that the discontinuity represented by this window tends to further encourage back-corona effects.

However, the apparatus disclosed herein pulses the electrostatic potential to a relatively high value. In response, the potentials across dust layer DL do not immediately rise. In fact the total potential from electrode PE to plate PL begins to fall before the potential of dust layer DL can rise significantly. Thus most of this higher potential exists between the electrode PE and the inside surface of dust layer D, that is, in the area where it can be most effective. Accordingly, the foregoing modulation of precipitator power produces a highly efficient transfer of energy into precipitation without causing sparking which may disturb the dust layer DL.

Referring to FIG. 5, a simplified digital to analog angle converter is shown which may be used in the converter 44 of FIG. 1. In this embodiment, the feature of increasing the electrostatic precipitator potential once during every nth cycle is achieved by hardware. In contrast, the previously described system achieved the increase of potential through software. Accordingly, a divide by n divider 500 is shown herein as a means for counting the passage of a predetermined number of half cycles. To this end, half cycles are detected at input terminal 120 of divider 500 which connects to the 120 Hz output of divider DIV (FIG. 1). The output of divider 500 produces a rising pulse edge once every nth half cycle. This divided output is applied to the input of one shot 502 to provide a pulse which is approximately one half cycle in duration. The output of one shot 502 is applied to a normal input of NAND gate 504 and an inverting input of NAND gate 506. The other normal inputs of NAND gates 504 and 506 are connected to terminals 245760 and 30720, respectively. These terminals are the corresponding terminals of FIG. 1 which carry the 245.76 kHz and 30.72 kHz signals, respectively. The outputs of NAND gates 504 and 506 are separately connected to the inputs of NAND gate 508 whose output connects to a normal input of AND gate 94. The inverting input of AND gate 94 is connected to the carry output $C_o$ of a counter 80. The output of AND gate 94 is connected to the clock input of counter 80. Preset enable terminal PE of counter 80 is connected to terminal 120 which was previously described in FIG. 1.

The inverting preset inputs of counter 80 are connected to the outputs of latch L6 whose inputs are connected to data lines DA which are data output lines from microcomputer COM (FIG. 1). Also the data strobe input DI for causing latch L6 to store the data on lines DA, is connected to terminal SEL which is another output of microcomputer COM. The carry output $C_o$ of counter 80 is also connected to a normal input of AND gate 110 and an inverting input of NOR gate 112. The other normal inputs of gates 110 and 112 are connected to previously mentioned terminal 60. The output of AND gate 110 is connected through resistor R32 to the base of NPN transistor Q4 whose emitter is grounded. The output of NOR gate 112 is connected through resistor R34 to the base of NPN transistor Q6 whose emitter is also grounded. The collectors of transistors Q4 and Q6, identified herein as terminals P12 and P10, respectively, may be transformed or coupled to the trigger electrodes of the thyristors of voltage controller 10 (FIG. 1). This interconnection may be as shown in FIG. 3 of U.S. Pat. No. 4,290,003.

The operation of the apparatus of FIG. 5 can be described as follows: Assume that the nth half cycle has not yet arrived and that one shot 502 produces a zero output voltage which when applied to NAND gate 504 forces its output to remain at a high level. Furthermore, NAND gate 506 is able to transfer the 30.72 kHz signal through NAND gate 508 to the normal input of AND gate 94.

The digital information supplied by the microcomputer on lines DA correspond to a desired conduction angle for the previously mentioned thyristors. This data can be strobed into latch L6 by a signal on line SEL. Thereafter, the latched data is applied to the presetting inputs of counter 80. Since the presetting inputs are complemented, the counter 80 is preset to a complementary number from which it then counts downwardly. Accordingly, by choosing the proper clock frequency and counting range, the counter 80 can count through a range which corresponds to the full 180° conduction angle. If the counter has a count range of 256, a clock repetition rate of 30.72 kHz will allow the counter to count down its full range in about 8 milliseconds which is the nominal duration of a half cycle of a 60 Hz power line.

At the end of the current half cycle, a triggering pulse is applied through preset enable terminal PE of counter 80. In response, the carry output $C_o$ of counter 80 goes low (assuming the preset input is not zero). Therefore, AND gate 94 transmits the 30.72 kHz signal from gates 506 and 508 to the clock input CL of counter 80. Consequently, after the expiration of a time period determined by the output of latch L6, counter 80 agains returns to a high state. This high signal is applied to a normal input of AND gate 110 and an inverting input of NOR gate 112. Consequently either of them can then provide a high signal. If the 60 Hz signal on terminal 60 is in a positive phase then a high output is produced from AND gate 110. Otherwise, a high output is produced from NOR gate 112. The foregoing assures proper phasing from one half cycle to the next. The high signal from either gate 110 or 112 causes transistor Q4 or Q6, respectively, to become conductive, causing current to be drawn by either terminal P12 or PlO, respectively. This conduction causes the firing of either thyristor Q1 or Q2 of controller 10 (FIG. 1).

The foregoing operation proceeds through several half cycles until the nth half cycle is reached. In a preferred embodiment described above n is equal to 6. At this nth half cycle, a positive signal from divider 500 triggers one shot 502 to apply a high input to a normal input of NAND gate 504 and to the inverting input of NAND gate 506. Consequently, NAND gate 506 produces a low signal and NAND gate 504 transmits the 245.76 kHz signal on terminal 245760 to an input of NAND gate 508. This 245.76 kHz signal is then applied to the normal input of AND gate 94. Accordingly, when the carry signal $C_o$ goes low on the expiration of the last half cycle, AND gate 94, receiving this low signal on its inverting input, is able to convey the 245.76 kHz signal to the clock input CL of counter 80.

This input frequency is eight times the clock frequency previously described. Consequently, any computer-commanded conduction angle is increased by a factor of eight. (Actually, the commanded initial "off" interval is divided by eight.) Therefore the thyristors Q1 and Q2 (FIG. 1) will commence conduction earlier than the other half cycles during which divider 500 (FIG. 5) is not influential.

It will be appreciated that the foregoing apparatus of FIG. 5 causes a periodic increase in the high voltage potential in the precipitator once every nth half cycle. This operation is similar to that described for the software control system of FIG. 1 except that the apparatus in FIG. 5 achieves this type of function strictly with hardware.

It is to be appreciated that various modifications may be implemented with respect to the above described preferred embodiments. The described apparatus may be constructed in alternate fashions using a different balance of digital and analog circuitry. Moreover, various alternate microprocessor programs may be employed in accordance with the above teachings. For example, certain steps may be reordered, deleted or supplemented in alternate configurations. Also, the sensitivity of the system to measured parameters may be adjusted to suit the specific precipitator that is being controlled. Furthermore, the number of half cycles which the computer awaits before increasing precipitator voltage can be changed. Similarly the extent to which precipitator voltage is changed for a half cycle can be altered depending upon the precipitator involved. In addition, while an increase in voltage is described for only a portion of a half cycle, in alternate embodiments a lesser time or several half cycles can be subjected to increased voltage. Moreover, it is anticipated that other embodiments will employ circuit components having different values, tolerances and ratings to provide the desired accuracy, power, speed etc.

Obviously, many modifications and variations of the present invention are possible in light of the above teachings. It is, therefore, to be understood that within the scope of the appended claims, the invention may be practiced otherwise than as specifically described.

What is claimed is:

1. In an electrostatic precipitator system powered by a primary power source, a power supply comprising:

a power means adapted to be coupled to said primary power source for producing a converted voltage with a frequency content different from that of said primary power source, said power means being operable to draw from said primary power source current that cycles at a central frequency; and a high voltage means coupled to and driven by said power means for producing from its converted voltage a high voltage having a nonaltering, high voltage component, said high voltage being influenced by said frequency content, said content of said converted voltage produced from said power means having at least one steady state frequency component lower in frequency than said central frequency at said power means for driving said high voltage means, said steady state component being sized to allow efficient precipitation.

2. A method for powering an electrostatic precipitator from a primary power source, comprising the steps of:

changing said primary power source into a converted voltage having a frequency content different from that of said primary power source by drawing current therefrom at a cycle corresponding to a central frequency; and producing from said converted voltage a nonalternating, high voltage component influenced by said frequency content, said content having at least one steady state frequency component lower in frequency than said central frequency at said primary power source and sized to allow efficient precipitation.

3. In an electrostatic precipitator according to claim 1 wherein said power means include:

modulation means for periodically increasing the amplitude of said converted voltage at the frequency of said steady state frequency.

4. In an electrostatic precipitator according to claim 3 wherein said modulation means comprises:

a controller having a control terminal for producing from said primary power source said converted voltage and for varying it in response to a control signal applied to said control terminal; and a command means for producing and applying the control signal to said control terminal, said command means periodically changing said control signal to increase the amplitude of said converted voltage.

5. In an electrostatic precipitator according to claim 4 wherein said modulation means includes:

sensing means coupled to said high voltage means for sensing a functional parameter thereof and providing a functional signal responsive thereto, said command means being coupled to said high voltage sensing means for receiving said functional signal and for varying said control signal to regulate the high voltage to keep said functional signal within a predetermined range.

6. In an electrostatic precipitator according to claim 5 wherein said primary power source is alternating and wherein said modulation means includes timing means coupled to said primary power source to produce an enable signal after a predetermined number of half cycles of said primary power source, said command means being coupled to said timing means to increase the amplitude of said converted voltage for at least a portion of the next half cycle in response to said enable signal.

7. In an electrostatic precipitator according to claim 6 wherein said timing means further comprises:

means for counting the passage of said predetermined number of half cycles and thereafter producing said enable signal, said modulation means being operable in response to said enable signal to increase said control signal by a predetermined amount during the following half cycle.

8. In an electrostatic precipitator according to claim 7 wherein said predetermined amount produced by said modulation means corresponds to increasing said control signal by a predetermined factor.

9. In an electrostatic precipitator according to claim 3 wherein the predetermined low frequency at which the amplitude of said converted voltage is periodically increased is sized to maximize the extent of precipitation.

10. A method according to claim 2 wherein said changing of said primary power source includes the step of:

periodically increasing the amplitude of said converted voltage at the frequency of said steady state frequency component, which is lower in frequency than said central frequency.

11. A method according to claim 10 further comprising the step of:

adjusting the magnitude of said converted voltage in a response to said functional parameter to change the operation of said precipitator and drive said parameter toward a predetermined range.

12. A method according to claim 2 further comprising the step of:

counting the passage of a predetermined number of half cycles of said primary power source; and increasing the amplitude of said converted voltage by a predetermined amount for at least a portion of the next half cycle.

13. A method according to claim 12 wherein said increasing by said predetermined amount corresponds to an increase by a predetermined factor.

14. A method according to claim 10 wherein the predetermined low frequency at which the amplitude of said converted voltage is periodically increased is sized to maximize the extent of precipitation.

* * * * *

UNITED STATES PATENT AND TRADEMARK OFFICE

CERTIFICATE OF CORRECTION

PATENT NO. : 4,587,475

DATED : May 6, 1986

INVENTOR(S) : James A. Finney, Jr. et al

It is certified that error appears in the above-identified patent and that said Letters Patent is hereby corrected as shown below:

On page 1, Item 73, line 6, please delete

"Foster Wheeler Energy Corporation
Livingston, N.J."

and insert in its place --Belco Pollution Control Corporation
Parsippany, New Jersey--

Signed and Sealed this

Twenty-fifth Day of November, 1986

*Attest:*

DONALD J. QUIGG

*Attesting Officer* *Commissioner of Patents and Trademarks*